US010235830B2

(12) United States Patent
Richardson

(10) Patent No.: US 10,235,830 B2
(45) Date of Patent: Mar. 19, 2019

(54) INTERACTIVE GAMING TABLE

(71) Applicant: Joseph Richardson, Fargo, ND (US)

(72) Inventor: Joseph Richardson, Fargo, ND (US)

(73) Assignee: Gaming Studio, Inc., Fargo, ND (US)

( * ) Notice: Subject to any disclaimer, the term of this patent is extended or adjusted under 35 U.S.C. 154(b) by 0 days.

(21) Appl. No.: 15/356,525

(22) Filed: Nov. 18, 2016

(65) Prior Publication Data

US 2017/0148249 A1 May 25, 2017

Related U.S. Application Data

(60) Provisional application No. 62/257,687, filed on Nov. 19, 2015.

(51) Int. Cl.
*A63F 9/24* (2006.01)
*G07F 17/32* (2006.01)

(52) U.S. Cl.
CPC ..... *G07F 17/322* (2013.01); *G07F 17/3209* (2013.01); *G07F 17/3211* (2013.01); *G07F 17/3248* (2013.01); *G07F 17/3288* (2013.01)

(58) Field of Classification Search
CPC ..... G07F 17/322; G07F 17/3209; G07F 17/3211; G07F 17/3248; G07F 17/3288
USPC ..... 463/17
See application file for complete search history.

(56) References Cited

U.S. PATENT DOCUMENTS

| | | | | |
|---|---|---|---|---|
| 7,374,359 | B1 * | 5/2008 | Annerino | G06F 3/03545 16/427 |
| 8,087,983 | B2 | 1/2012 | Longway | |
| 8,926,421 | B2 * | 1/2015 | Arezina | G07F 17/3204 463/20 |
| 9,165,431 | B2 | 10/2015 | Chun | |
| 9,230,398 | B2 | 1/2016 | Chun | |
| 9,542,797 | B2 * | 1/2017 | Detlefsen | G07F 17/3209 |
| 2004/0166936 | A1 * | 8/2004 | Rothschild | G07F 17/32 463/35 |
| 2005/0119039 | A1 * | 6/2005 | Berman | G07F 17/32 463/16 |

* cited by examiner

*Primary Examiner* — Jay Trent Liddle
*Assistant Examiner* — Ryan Hsu
(74) *Attorney, Agent, or Firm* — Danielson Legal LLC

(57) ABSTRACT

Methods and systems for interactive networked gaming. The system may include an interactive electronic gaming display configured to present a plurality of virtual chips to each of a plurality of gamers. The interactive display may be configured to receive a wager form a wagering device used by at least one of a plurality of gamers. The interactive display may be configured to animate a plurality of virtual chips in accordance with a plurality of animations and configured to enable chip transactions between at least two fund accounts.

11 Claims, 6 Drawing Sheets

INTERACTIVE GAMING TABLE

CROSS REFERENCE TO RELATED APPLICATIONS

The present application claims the benefit of U.S. provisional application No. 62/257,687, filed on Nov. 19, 2015, the entire disclosure of which is incorporated by reference as if set forth in its entirety herein.

TECHNICAL FIELD

This invention generally relates to systems, devices, and methods for gaming and, more particularly, to systems, devices, and methods for electronic gaming within networked systems.

BACKGROUND

The use of network-connected gaming machines is known. For example, many casinos have progressive jackpot gaming machines that share a collective jackpot pool. This jackpot pool increases based on the activity of any of the machines in the pool.

As another example, lotteries have video poker machines (often called "video lottery terminals") that are connected together in jurisdiction-wide networks. The network essentially maintains accounting and activation of devices that individually determine wins and losses for each gaming session.

Some states also permit electronic pull tab and electric bingo networks. With electronic pull tab games, a server provides a finite set of wagers among which there are a finite quantity of winning and losing wagers. With electronic bingo games, the network is often tasked with supplying the winning numbers, tracking outcomes for all active players, and pooling the pot for a larger prize.

These electronic gaming systems have become increasingly popular. In North Dakota, for example, there are approximately 800 bars, taverns, hotels, and other types of on-sale liquor establishments that are licensed or otherwise authorized to host wager-based gaming activities on a nightly basis. Table games may include either "21" or games that involve large mechanical wheels. Placing wagers for both of these types of games involves placing chips of various values on cloth table layouts.

In games involving wheels, the layouts contain graphic areas that indicate which numbers, symbols, and/or number-symbol combinations appearing on the wheel that a player wishes to bet will be indicated as winning after a hand-spun wheel stops spinning. Once the wheel stops spinning, chips on the graphic areas that are associated with losing bets are removed by the operator. Players that placed chips on winning areas are then paid the appropriate amount in chips.

In Minnesota, for example, there are approximately 2,700 bars, taverns, hotels, and other on-sale liquor establishments that are licensed or otherwise authorized to host wager-based gaming activities. The only table games that are allowed are those that involve a wheel wherein a player acquires tickets with chips that have been purchased for a certain value. Players may then place their tickets in one of approximately 100 slots that are associated with a number or a set of numbers on the wheel.

Once the wheel has been spun (and stops), tickets that are associated with slots in numbered fields on the table that are not associated with the indicated winning number (or sets of winning numbers) are removed and ripped in half. Tickets that are associated with the indicated numbers or sets of numbers are extracted, marked as winners, and the amount won is written on the ticket. Chips associated with the winning amount are then paid to the player and all such marked tickets are saved.

The employees that manually spin these wheels can become quite proficient in spinning the wheel to a certain segment of the wheel, thereby providing players with a great advantage over the "house." This spinning of the wheel to intentionally land in a certain segment is known in the art as "pitching the wheel."

Another cause for concern for the house and regulatory officials is the opportunity for operators to allow the late placement of wagers. For example, operators in North Dakota may allow for the late placement of chips, and operators in Minnesota may allow for the late placement of tickets. This is particularly true if all players at the table are co-conspirators with the wheel operator. Although video cameras are used, they are not always checked, thereby allowing players and wheel operators to unfairly take advantage of the house without consequences.

In both of the above-mentioned states, losing wagers can be paid as if they were winning wagers (e.g., by accident or due to dishonest payers and/or wheel operators) with minimal chance of being detected. This is particularly true if there is only one player involved in the game.

Another drawback of existing systems is waste. In Minnesota, for example, where both chips and tickets are used in the wagering process, the cost of the tickets is about 2.6 ¢ each. This is a large expense for a game that has a house advantage as low as 12.5%. Accordingly, this requires nearly 21% of gross winnings to be devoted just for the paper tickets consumed.

A need exists, therefore, for networked gaming systems, devices, and methods that overcome the above disadvantages of existing gaming networks.

SUMMARY

This summary is provided to introduce a selection of concepts in a simplified form that are further described below in the Detailed Description section. This summary is not intended to identify or exclude key features or essential features of the claimed subject matter, nor is it intended to be used as an aid in determining the scope of the claimed subject matter.

In one aspect, embodiments relate to an interactive gaming system. The gaming system includes an interactive electronic gaming display configured to present a plurality of virtual chips to each of a plurality of gamers, and further configured to receive a wager from a wagering device used by at least one of the plurality of gamers to: select at least one virtual chip; and place the at least one virtual chip on a portion of the display that represents the wager.

In one embodiment, the wagering device is a wand device.

In one embodiment, the wagering device is a hand device configured to be attached to a gamer's hand.

In one embodiment, the plurality of virtual chips includes at least one chip eraser accessible by at least one of the plurality of gamers to cancel a previously made wager.

In one embodiment, the received at least one wager relates to a paddlewheel-type game. In one embodiment, the received at least one wager relates to an outcome generated by a plurality of independent simulated wheels.

According to another aspect, embodiments relate to a gaming wand for placing a wager via an interactive electronic gaming display. The gaming wand is configured to select at least one virtual chip presented on the display by contacting a first portion of the display; and place the at least one virtual chip on a portion of the display that represents a wager.

In one embodiment, the wand device includes at least one of a chip loading button, a chip emitting button, a display, and a contact portion for contacting the at least one display.

In one embodiment, the wand device is adjustable to at least two different lengths.

In one embodiment, the wand device is configured to emit a plurality of chips simultaneously or load a plurality of chips simultaneously.

In one embodiment, the wager relates to a result outputted by a paddlewheel-type game.

According to yet another aspect, embodiments relate to an interactive gaming system. In these embodiments, the system includes an interactive electronic gaming display configured to present a plurality of virtual chips to each of a plurality of gamers, wherein the interactive electronic gaming display is further configured to animate the virtual chips in accordance with a plurality of animations in response to activation of the interactive electronic display by at least one gamer, and enable chip transactions between at least two fund accounts in response to movement of at least one chip from a first portion of the interactive electronic display that corresponds to a first fund account to a second portion of the interactive electronic display that corresponds to a second fund account.

In one embodiment, the first fund account is an account configured for a gamer and the second fund account is an account configured for a table operator.

In one embodiment, a gamer may move the at least one chip from the first portion to the second portion by: touching the display with their finger at the first portion of the display that corresponds to at least one chip; making a dragging gesture on the display to move the at least one chip from the first portion to the second portion; and removing their finger from the display at the second portion.

In one embodiment, a gamer may move the at least one chip from the first portion to the second portion by: touching the display with their finger at the first portion of the display that corresponds to at least one chip; and making a sweeping or flicking gesture on the display to propel the at least one chip in a trajectory that ends at the second portion. In one embodiment, the at least one chip may appear to travel below other graphics that are presented by the display while moving towards the second portion of the display.

BRIEF DESCRIPTION OF DRAWINGS

Non-limiting and non-exhaustive embodiments of the invention are described with reference to the following figures, wherein like reference numerals refer to like parts throughout the various views unless otherwise specified.

DETAILED DESCRIPTION

Figure 1:
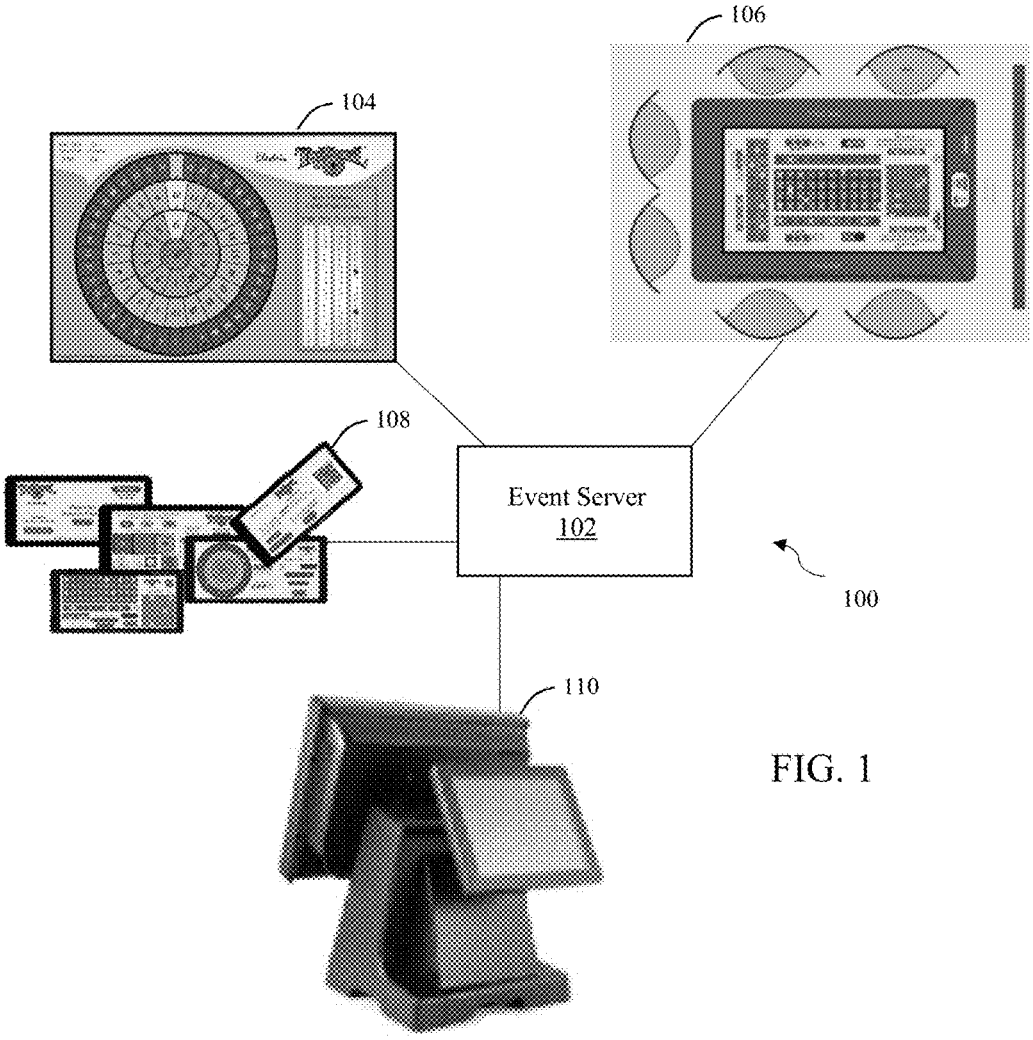
FIG. 1 illustrates a networked interactive gaming system in accordance with one embodiment.

Various embodiments are described more fully below with reference to the accompanying drawings, which form a part hereof, and which show specific exemplary embodiments. However, the concepts of the present disclosure may be implemented in many different forms and should not be construed as limited to the embodiments set forth herein; rather, these embodiments are provided as part of a thorough and complete disclosure, to fully convey the scope of the concepts, techniques and implementations of the present disclosure to those skilled in the art. Embodiments may be practiced as methods, systems or devices. Accordingly, embodiments may take the form of a hardware implementation, an entirely software implementation or an implementation combining software and hardware aspects. The following detailed description is, therefore, not to be taken in a limiting sense.

Reference in the specification to "one embodiment" or to "an embodiment" means that a particular feature, structure, or characteristic described in connection with the embodiments is included in at least one example implementation or technique in accordance with the present disclosure. The appearances of the phrase "in one embodiment" in various places in the specification are not necessarily all referring to the same embodiment.

Some portions of the description that follow are presented in terms of symbolic representations of operations on non-transient signals stored within a computer memory. These descriptions and representations are used by those skilled in the data processing arts to most effectively convey the substance of their work to others skilled in the art. Such operations typically require physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system memories or registers or other such information storage, transmission or display devices. Portions of the present disclosure include processes and instructions that may be embodied in software, firmware or hardware, and when embodied in software, may be downloaded to reside on and be operated from different platforms used by a variety of operating systems.

The present disclosure also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each may be coupled to a computer system bus. Furthermore, the computers referred to in the specification may include a single processor or may be architectures employing multiple processor designs for increased computing capability.

The processes and displays presented herein are not inherently related to any particular computer or other apparatus. Various general-purpose systems may also be used with programs in accordance with the teachings herein, or it may prove convenient to construct more specialized apparatus to perform one or more method steps. The structure for a variety of these systems is discussed in the description below. In addition, any particular programming language that is sufficient for achieving the techniques and implementations of the present disclosure may be used. A variety of programming languages may be used to implement the present disclosure as discussed herein.

In addition, the language used in the specification has been principally selected for readability and instructional purposes and may not have been selected to delineate or circumscribe the disclosed subject matter. Accordingly, the present disclosure is intended to be illustrative, and not limiting, of the scope of the concepts discussed herein.

Features of various embodiments described herein allow for a networked gaming system with an interactive gaming display. These displays may be configured as tables and may be placed in various locations such as bars, taverns, hotels, casinos, airports, and other types of on-sale liquor establishments, for example. This list is non-exhaustive and it is expressly contemplated that other types of establishments may house these gaming tables of various embodiments.

FIG. 1 illustrates the architecture of the networked gaming system 100 in accordance with one embodiment. The system 100 may include an event server 102, and include or otherwise be in communication with one or more of a gaming display 104, a gaming table 106, mobile device(s) 108 (for managing a player's account as well as for gaming), and kiosk terminal(s) 110. The event server 102 may be in communication with these components via any wired or wireless connection technologies known in the art.

Figure 2:
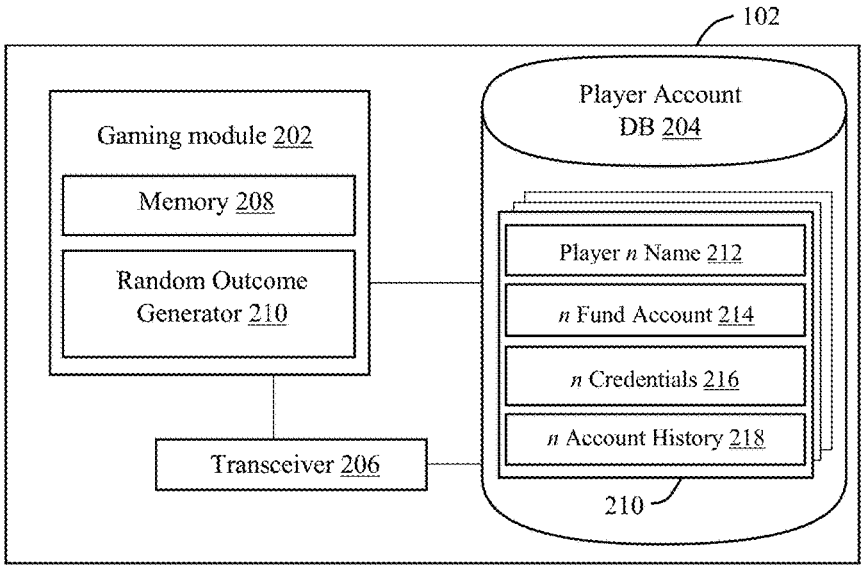
FIG. 2 illustrates the event server of FIG. 1 in accordance with one embodiment.

The event server 102 may be implemented as a specially configured computer device that executes various applications. FIG. 2 illustrates the event server 102 of FIG. 1 in accordance with one embodiment. In this particular embodiment, the event server 102 may include at least one gaming module 202 (e.g., one for each game), a player account database 204, and a transceiver device 206.

Although only one gaming module 202 is illustrated in FIG. 2, the event server 102 may include multiple gaming modules 202 that are each tasked with executing various games via the networked system 100. The gaming module 202 may further include a memory 208 and a random outcome generator 210.

The memory 208 may be L1, L2, L3 cache or RAM memory configurations. The memory 208 may include non-volatile memory such as flash memory, EPROM, EEPROM, ROM, and PROM, or volatile memory such as static or dynamic RAM, as discussed above. The exact configuration/type of memory 208 may of course vary as long as information such as gaming instructions can be stored and retrieved for gaming execution. For example, the memory 208 may store instructions and rules for specific types of games.

The random outcome generator 210 may be configured to generate one or more random outcomes for particular games. The generated random outcomes may of course vary and depend on the particular game. For example, some games may require the generation of a number, a set of numbers, a color, a combination of number(s) and colors, or the like.

The random outcome generator 210 may be in operable communication with memory 208 to receive instructions and/or rules regarding acceptable outcomes. For example, based on the particular games, the outcome may be required to be within a certain numerical range. Once the random outcome generator 210 generates a random outcome, it may communicate the generated outcome to one or more components such as those illustrated in FIG. 1, thereby concluding a gaming round.

The event server 102 may also include one or more player account databases 204. The player account database 204 may at least store data related to individual players in the form of player profiles 210. The player profiles may include data regarding a player's name 212, a player's fund account 214, the player's credentials 216, and the player's account history 218.

In the context of the present application, the player's name 212 may include their birth name, nicknames, addresses, and other types of identifying information.

The fund account information 214 may relate to the amount of funds a player has access to with which to make wagers.

Credentials 216 may include data specific to a particular player. For example, credentials 216 may include identifying information such as player user names, passwords, personal identification numbers (PINs), fingerprint identification information, or the like. This information may be stored to ensure security, to prevent unauthorized players from making deposits or withdrawals, or to prevent the unauthorized placement of wagers using funds from another player's fund account.

The player's account history 218 may include data regarding the player's gaming history and/or the player's transaction history. For example, the database 204 may log and store gaming history data such as the wagers a particular player has made (e.g., particular numbers, colors, the values of the wagers) as well as the time and date of each wager. Additionally or alternatively, the database 204 may log and store transaction data such as the times and dates of withdrawals/deposits, as well as the amounts of such withdrawals/deposits.

The event server 102 may also include a transceiver device 206. The transceiver device 206 may be in operable communication with other servers, gaming devices, or other locations. For example, the transceiver 206 may be in operable communication with governmental authorities or agencies. These bodies or agencies may query the event server 102 via the transceiver 206 to, for example, gather data regarding a particular gaming establishment, data regarding a game, data regarding a player (such as any type of data stored in the player account database 204), or the like. Additionally, the transceiver device 206 may be in communication with financial institutions such as banks to enable players to withdraw/deposit funds.

The event server 102 (namely, the gaming module 202) may generate random outcomes at regular time intervals and/or when prompted by an operator. The event server 102 may be further configured to deliver these random outcomes to displays such as a display 104, table 106, mobile devices 108, and/or kiosk devices 110.

For example, in one embodiment, the game may involve a spinning tri-wheel such as the one shown on the display 104 of FIG. 1. In one embodiment, players may be positioned around a gaming table such as the table 106 of FIG. 1, and an operator may be standing or sitting at one end of the table. Additionally, a display such as the gaming display 104 of FIG. 1 may be located behind the operator (e.g., mounted on a wall). The operator may explain the rules of a particular game, answer any questions about the game, decide when to close wagering and call for the event server 102 to generate an outcome, and receive cash and print redeeming payout credits, etc.

The displays 104 and table(s) 106 may therefore mimic the gaming and social experience of conventional casinos and other types of gaming establishments. Players may, by interacting with the gaming table 106 (which may include an interactive touch screen display), learn the rules of a game, place wagers, collect payments, or the like.

As mentioned above, some games may be paddlewheel-based games. In these types of games, a table 106 is accompanied by a display 104 that provides simulated imagery of one or more rotating wheels. Once activated (i.e., once a gaming session is initiated), the wheel(s) on the display 104 may start to spin. The simulated wheel may start to spin very fast and then gradually slow before coming to a stop. Once the simulated wheel(s) have stopped spinning, the selected number (the number(s) that are in a certain position on the wheel(s) at the conclusion of the wheel spin) is indicated as a winning value. The simulated wheels may present the numbers in a consecutive sequence (rather than scattered). That is, the numbers may increase in value in a clockwise fashion. This allows players to more easily follow their prospects of winning, especially as the wheel appears to slow down in its simulated spin.

The table(s) 106 may be configured with an interactive display that presents a wagering area that includes numbers, letters, symbols, or indicia appearing on the wheel(s). The wagering areas associated with the numbers or symbols appearing at the top of the simulated wheel during at the spin may temporarily light up. That is, when a "6" is at the top of the wheel as the wheel is spinning, the wagering field or background associated with "6" on the table 106 may light up. As the wheel spins and a "7" is at the top of the wheel, the wagering field behind "6" on the table may dim, and the wagering field behind "7" on the table may light up. These features essentially result in a light show on the table 106 as the wagering fields quickly light up and then dim on the table 106. Accordingly, the progress of the simulated wheel spin can be seen by watching the simulated wheel and/or watching the wagering fields or areas on the table display 106.

Figure 3:
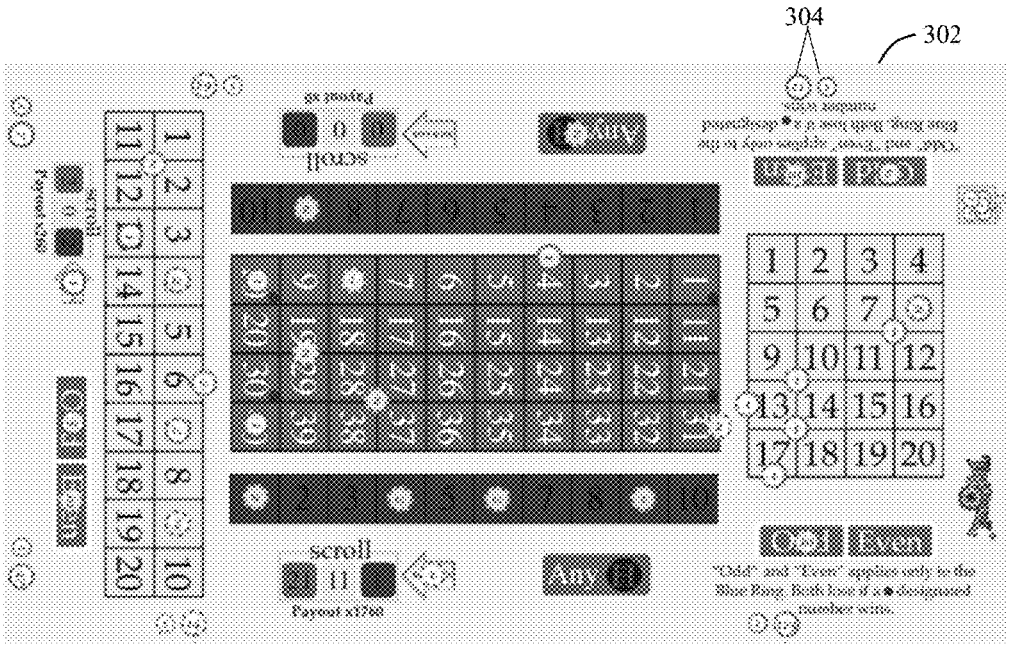
FIG. 3 illustrates a gaming table display in accordance with one embodiment.

Players may place their wagers before each round in a variety of ways. Generally, players may place their wagers by moving their virtual chips to certain locations on the display of the gaming table 106. FIG. 3 illustrates an exemplary gaming table display (hereinafter "table") 302 in accordance with one embodiment. This gaming table 302 may be configured as an interactive touch screen device that presents digital images or graphics representing the field of potential wagers that is common to all players arrayed around the table 302. Players are therefore all able to place virtual chips on the same wagering area.

As shown, the gaming table 302 may present virtual chips 304 to each player (chips are shown for each player position). Players may move the chips 304 to various locations on the table 302 (e.g., through contact with the touch-screen) to place one or more wagers.

Figure 4:
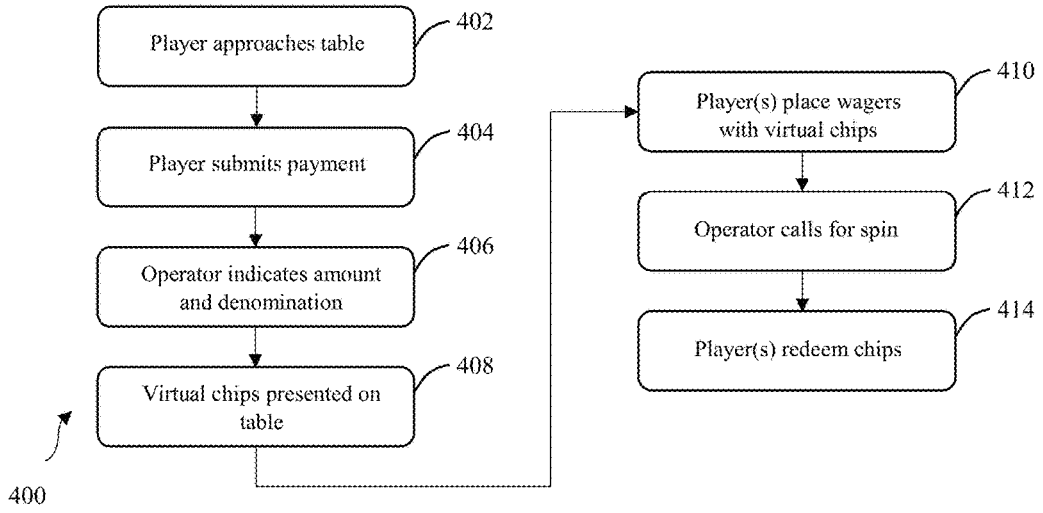
FIG. 4 depicts a flowchart of a method of a wagering process in accordance with one embodiment.

FIG. 4 depicts a flowchart of a method 400 of a wagering process in accordance with one embodiment. Step 402 involves a player approaching a table such as the table 302. The game operator may then ask if the player has played before and, if not, offer to assist them. The operator may suggest, for example, that the player starts with a small amount (e.g., $5.00) worth of 10¢ virtual chips to at least gain some experience. In some embodiments, there may be only one denomination allowed at a particular table 302.

Step 404 involves the player submitting payment. Once the player decides on the amount of chips they would like to purchase, they may pay the operator the appropriate amount (e.g., in the form of dollar bills or coins). The operator may then lay the amount tendered on the table 302 so that the other players can see the amount. The operator may additionally verbally announce the total amount paid to the other players at the table 302.

Figure 5:
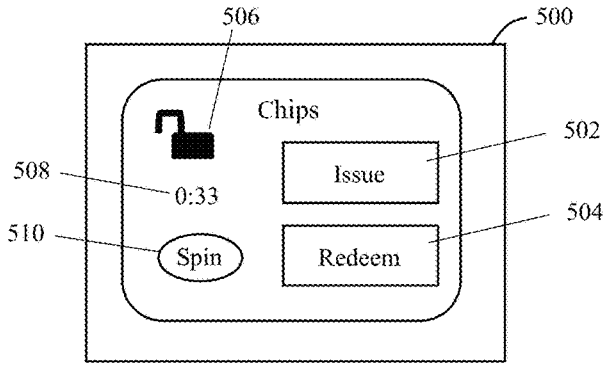
FIG. 5 illustrates an exemplary operator console in accordance with one embodiment.

Step 406 involves the operator indicating the appropriate chip amount and the desired denomination. The table 302 may be configured to present an operator's console such as the operator's console 500 of FIG. 5. The operator's console 500 may include an issue option 502, a redeem option 504, a locking toggle icon 506 for locking and unlocking the table 302 (e.g., to prevent any wagers from being placed, moved or removed, as well as to prevent any other actions on the table while the table is locked—for instance if the table surface needs to be cleaned), a timer 508 that shows how long the table has been open for wagering, and a spin option 510 to call the server 102 to activate a spin.

To issue the appropriate amount of chips to the player, the operator may first press, poke, or otherwise select the issue option 502 on the operator's console 500. The operator's console 500 may then present a "Chip Issue" screen that asks the operator to enter the player's position at the table 302, the amount tendered, and the desired denomination. Thus, the operator may enter "position 1, $5.00, and 10¢," and an array of virtual chips may appear in front of the operator on the table 302 (step 408). The chips may then appear to quickly move over to the appropriate player position. The player's home stack of chips may then present a stack of virtual chips that would have the number "50" on it to indicate 50 chips. The operator may then place the tendered cash into a slot for a box within or otherwise near the table 302.

Figure 6:
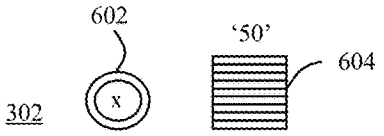
FIG. 6 depicts an exemplary eraser chip and a stack of virtual chips in accordance with one embodiment.

The gaming table 302 may also present a virtual eraser chip 602 unique to each player as illustrated in FIG. 6 that is labeled with an 'x.' Players may move the eraser chip 602 over their chips that have been wagered on the gaming table 302 to cancel that particular wager, for example. The previously wagered chip may then return next to the stack 604 of the player's virtual chips.

The above discussed steps for obtaining virtual chips for gaming are merely exemplary. It is contemplated that other methods may be used as long as players can receive chips for gaming.

Step 410 of method 400 involves player(s) placing their wagers with their chips. Once players have their chips, they may move their chips to certain locations on the gaming table 302 that represent wagers. Players may move chips by, for example, placing their finger on a chip, holding their finger on chip, dragging their finger over the display to a particular location on the display, and lifting their finger from the gaming table 302. The virtual chip(s) may then remain at a certain portion of the gaming table 302 for a wager. Tapping the placed chip within a certain short period of time of having placed the chip increases the quantity of chips being wagered, consequently decreasing the corresponding quantity from 604.

Figure 7A:
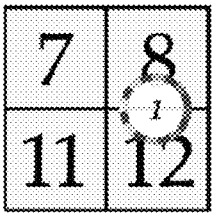
FIGS. 7A-C illustrate exemplary options for chip placement for wagering in accordance with one embodiment.
Figure 7B:
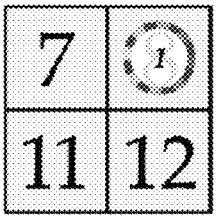
Figure 7C:
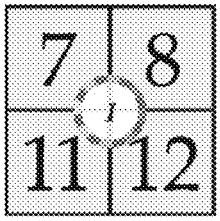
Figure 8A:
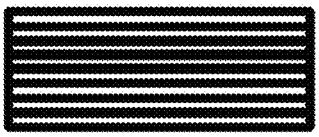
FIGS. 8A-G illustrate exemplary patterns, layouts, and animations for virtual chips in accordance with one embodiment.
Figure 8B:
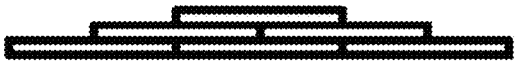
Figure 8C:
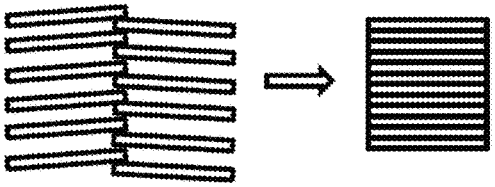
Figure 8D:
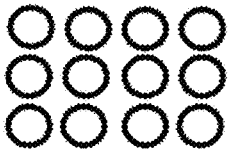
Figure 8E:
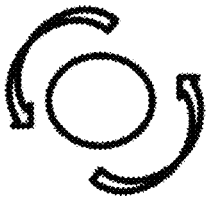
Figure 8F:
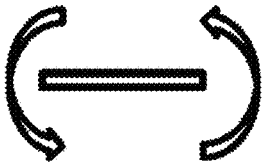
Figure 8G:
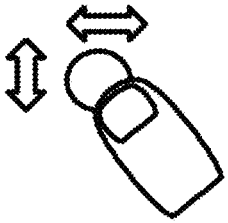

FIGS. 7A-C illustrate various options for chip placement. As shown, a player may place one or more chips at the intersection of two squares representing a wager for two values (FIG. 7A), in one square representing a wager for a single value (FIG. 7B), or at the intersection of four squares representing a wager for all four values (FIG. 7C). The gaming table 302 and the chips may be configured so that the chips "snap" in to a certain portion or area on the gaming table 302 and remain there until the round has completed. Additionally, if a player is dragging a chip (e.g., to make a wager or a tip) and lifts their finger from the gaming table 302, the dragged chip(s) may automatically move back to the home stacks of chips.

Each player's station at the gaming table 302 may present a list of all current wagers the player has made for the round. This may be particularly helpful when there are already several chips (e.g., placed by other players) in a certain portion of the gaming table 302 and visibility of that portion is low. These "navigation" images or lists may summarize a player's placed wagers for the player's reference and for the player to ensure their wagers have been made properly. These navigation images may be images such as those of FIGS. 7A-C and/or may be presented in the form of a list, a table, a graphical image representative of the gaming table 302, etc.

Referring back to FIG. 4, step 412 involves the operator calling the event server 102 for a spin. Once a table operator feels that players at the table have completed their wager selections, the operator may call the event server 102 for a simulated spin via the spin option 510. As soon as the operator calls for a spin, the table is locked for any further activity. All wagers that have been placed before the time of the spin call may be recorded and stored in memory of a local CPU (of the particular gaming table 106) and/or stored in the memory 208 of the event server 102. This sends a full accounting to the event server 102 that includes the chip quantity for each player, where their chips are on the table, how much the player(s) wagered, etc. By sending the table accounting to the event server 102 prior to each spin, features of various embodiments of the present invention provide a redundancy that allows for the reconstruction of a table 302 in the event something were to disable the table 302.

Once the event server 102 has stored the data regarding the placed wagers and received the call for the spin, the event server 102 may request a code for a target number for each of the rings of the wheel (if more than one), and the random outcome generator 210 may output an encoded random outcome selection that is passed on to the particular table's CPU (and associated display 104). This may trigger a simulated graphic rotation of an animated wheel or wheels (such as the wheel(s) shown on display 104 of FIG. 1).

Once the simulated wheel(s) stop spinning and reveal the outcome(s) generated by the random outcome generator 210, the virtual chips on the table 302 that are associated with non-winning wagers will disappear. For visual stimulation and additional entertainment, these losing virtual chips may disappear in an animated puff of smoke with an accompanying sound or other types of visual and/or audio stimuli.

Virtual chips on the table 302 that are associated with winning wagers may be animated to quickly expand in size and move to the appropriate player's home stack of chips, thereby representing an increase in chip value. The quantity/number shown above the winning players' home stack of chips may similarly increase until reaching the new total based on the win payout. This increase may be accompanied by an associated sound. Once all virtual chips have been moved from the table and the players' accounts are updated, the operator may call for a new round of wagering.

Referring back to FIG. 4, step 414 involves the player(s) redeeming their chips. Once a player wishes to stop playing and leave the table 302, they may request redemption of chips from the table operator. Or, they may wish to surrender chips of a certain denomination for those of another value or convert their chips to issue to another player. The table operator may select the redeem option 504 on their operator console 500. The operator console 500 may present a "Redeem" screen to the operator and the operator may then select/enter the player's position and select a "cash out" option to cash out all or some of the player's chips.

A printer in proximity to the table 302 (e.g., under the operator console 500) may provide the operator with a printed receipt that includes security coding, the quantity of chips, the value of each chip cashed out, and the total value of the cash out. The player may then take the printed receipt to a person designated as the cashier for the purposes of paying players. The digital table game CPU may communicate with the cashier as to all outstanding receipts for verification purposes. A player may merely wish to cash out of one denomination in trade for another. This may also be done under the "redeem" option.

The gaming table 302 may also keep players engaged. In conventional gaming institutions such as casinos, players often have to wait between rounds or wait for other players at their table to place their wagers or otherwise decide how they want to play a round. For example, in some games, players may take turns placing their wagers by going around the table.

Players may inevitably become bored as they wait for the other players to take their turns and place their wagers. In conventional casinos or other gaming establishments, players often play with their chips to keep themselves occupied. Players may, for example, shuffle their chip stacks in their hand(s), flip chip(s) over their fingers, build tower(s) with their chips, organize their chips by color/denominations, or the like.

Although the gaming table 302 in accordance with various embodiments eliminates the need for physical chips, the gaming table 302 may nonetheless enable similar types of entertainment. A player may interact with the gaming table 302 to move their virtual chips in certain ways, e.g., by creating swirling designs and patterns that entertain them and other players.

FIGS. 8A-G illustrates several patterns, layouts, or animations the virtual chips can make when the player interacts with the gaming table 302 in what may be referred to as "creative pattern" mode. A player may enter creative pattern mode by tapping the table display 302 (i.e., the touch screen), with two or more fingers, with two or more fingers simultaneously, by using their entire palm, by double tapping their chips, etc. The gaming table 302 may be preloaded with animated chip movements such as those in FIGS. 8A-G so that the chips move in certain ways in response to a player tapping or otherwise touching the screen of the gaming table 302. A first tap may cause the chips to sort into a stack (FIG. 8A), a second tap may cause the chips to sort into a pyramid configuration (FIG. 8B), a third tap may cause the chips to shuffle into a tower (FIG. 8C), etc.

Other types of movements or animations may cause the chips to rotate, flip, change color, shuffle, or the like. Similarly, a player may randomly move the chips with their fingers as they wish. Arching three fingers could make different multi-chip motions than arching with two or four fingers—for example, by creating swirls and loops.

Accordingly, these animations may keep a player engaged and entertained so they do not become bored while waiting for other players to take their turns. This also makes the electronic gaming experience similar to conventional gaming experiences to which players have become accustomed.

In addition to providing entertainment and enabling players to play games, the gaming table 302 of various embodiments may enable chip/monetary exchanges. For example, at conventional casinos and gaming establishments, it is common for players to tip dealers or game operators after a round or at the conclusion of a gaming session. The gaming table 302 may similarly enable a player to transfer chips (i.e., money) to a table operator.

Figure 9:
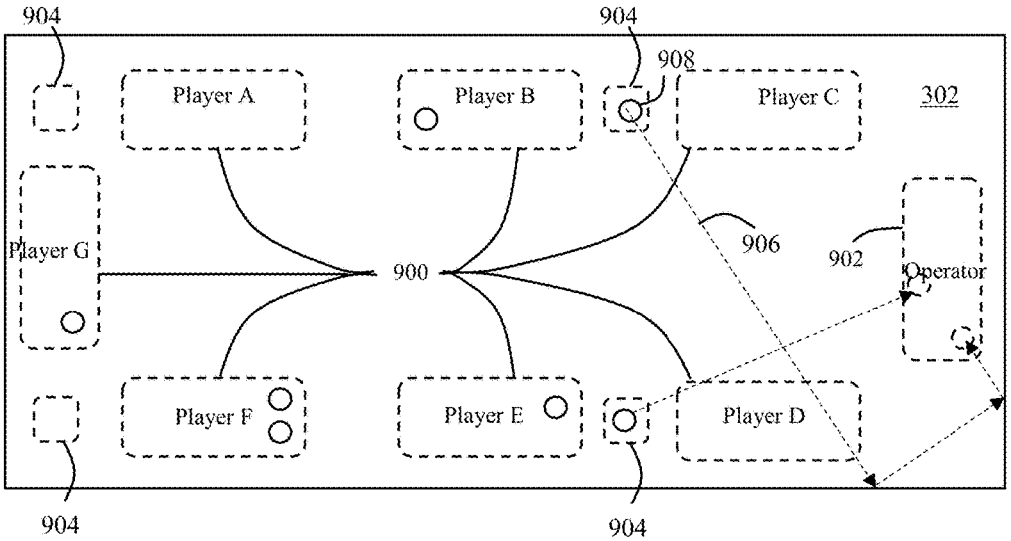
FIG. 9 illustrates a gaming table display in accordance with another embodiment.

FIG. 9 illustrates the gaming table 302 in accordance with one embodiment. As shown, the table 302 may include a plurality of portions 900 that correspond to stations of each player A-G at the table 302. Each portion 900 for the various players may be where the player's virtual chips are located. The table 302 may also include a designated operator portion 902 for the operator.

Players may use the operator portion 902 to tip the operator. For example, players may tip the operator by moving or flicking (in what may be referred to as "flick tipping" mode) a chip towards an operator's tip box 902. Or, players may tip an operator by quickly moving a finger over their home stack, or over a tip-dedicated location 904 adjacent to the home stack or player's portion 900 to virtually send a chip in the direction of the operator portion 902. The chip may then travel towards the operator portion 902. However, it may appear to "duck" under all of the graphics upon which players may place their wagers as the chip(s) travel to the operator portion 902.

In certain embodiments, players can attempt to bank a chip into the operator's portion 902 by flicking the chip in a direction that will cause it to bounce of the side of the digital surface. Path 906 of FIG. 9 shows a chip 908 traveling from a tip portion 904 and bouncing off of walls to "land" in the operator's portion 902. If the chip misses the operator's portion 902, it may return to the appropriate player. This way, players can develop a movement art to tipping. Again, any flipped chip may move in a graphical layer below the graphics on the table 302.

Another embodiment of tipping may be referred to as "sling tipping" in which a player moves a tip to the dedicated tip portion 904 adjacent to their home stack, and this dedicated portion 904 may serve as a ramp. The player may then tap the chip to increase the quantity of chips to be used for a tip, and then "pull" (as if in a sling-shot device) the tip back way from the ramp by dragging their finger, and then lift their finger from the table 302 to release or otherwise shoot the tip from the ramp, across the table 302, and to the operator's portion 902.

Figure 10A:
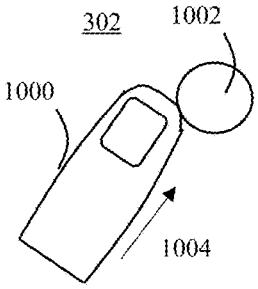
FIGS. 10A-B illustrate an exemplary tipping technique in accordance with one embodiment.
Figure 10B:
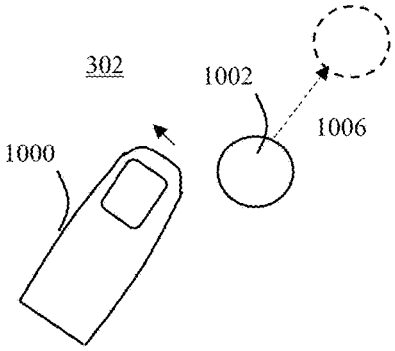

For example, FIGS. 10A-B illustrate an exemplary embodiment of this tipping technique. As seen in FIG. 10A, a gamer may move their finger 1000 to touch a virtual chip 1002 on the display 302. The gamer may then make a gesture by moving their finger 1000 in the direction of the arrow 1004. As shown in FIG. 10B, the gamer may lift their finger 1000 from the display 302. The virtual chip 1002 may then travel in the direction indicated by arrow 1006 (which may be substantially similar to the direction of arrow 1004).

The appropriate amount of funds (based on the denomination and number of chips moved) may then be transferred from the player's account to an account set up specifically for the table's operator. Accordingly, these processes may replicate the tipping process of conventional gaming establishments while providing an additional level of entertainment.

Figure 11:
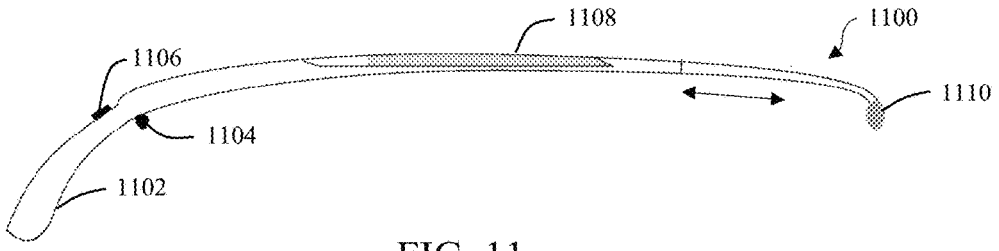
FIG. 11 illustrates a gaming wand device in accordance with one embodiment.

In addition to using their fingers/hands to move their virtual chips, players may also use a wand device such as the one illustrated in FIG. 11. There may be several of these wands 1100 at each gaming table 302 to use, or players may use their own personal wand 1100.

These wands 1100 may enable players to place wagers, cancel wagers, or place tips. By using these wands 1100, players do not need to physically touch the gaming table 302 (i.e., a display screen). This prevents or at least decreases the spread of germs and encourages good hygiene among the players at the gaming table 302.

In the exemplary embodiment of FIG. 11, the wand 1100 may have a handle 1102, a chip emitting button 1104, a chip loading button 1106, a wand display 1108, and a contact portion 1110. The wand 1100 illustrated in FIG. 11 is merely exemplary and wands may vary in shape and size, and may include or lack one or more of the illustrated features.

In use, a player may initialize or otherwise pair their wand 1100 to their home stack of chips by touching the wand's contact portion 1110 to their home stack on the table 302. This pairing may allow the home stack of chips to keep a synchronized, real time balance with the wand 1000 such as when the wand 1100 loads, emits or erases chips.

A player may "load" their wand 1100 with one or more chips by establishing contact between the contact portion 1110 and a portion of the gaming table 302 that shows the player's virtual chips. The wand 1100 may be configured to load chips once the contact portion 1110 touches the virtual chips, or a player may be required to press the chip loading button 1106 once the contact portion 1110 touches the virtual chips. Or, once a player synchronizes their wand 1100 with their home stack of chips, they can simply press the chip loading button 1106 to load chips on to the wand (even if the contact portion 1110 is not touching the table).

Once the player loads chips onto the wand 1100, the player may then move the wand 1100 (i.e., the contact portion 1110) to a portion of the gaming table 302 to place their wagers or to transfer chips. To place their virtual chips in a certain location, the player may position the contact portion 1110 on the display at the particular location, and press the chip emitting button 1104 to emit a chip. Each time the player presses the chip emitting button 1104 a chip may be emitted to the corresponding location on the gaming table 302 based on the location of the contact portion 1110.

Players or operators may configure the wand 1100 to emit a certain number of chips whenever the player presses the chip emitting button 1104. For example, the wand 1100 may be configured to emit three chips (as opposed to only one) each time the player presses the chip emitting button 1104.

If a player accidentally presses the chip emitting button 1104 too many times and/or if the player changes their mind about a certain wager, the player may press the chip loading button 1106 to erase a wager or otherwise reclaim a chip. In some embodiments, a player may similarly move the contact portion 1110 over one or more virtual chips they have placed on the gaming table 302 for a wager, and press and hold the chip loading button 1106 to erase their wagers and reclaim the entire stack (or press the chip loading button 1106 once for each chip they wish to reclaim). In other embodiments, a player may press and hold the chip loading button 1106 to reclaim all of their chips from the gaming table 302 (even if the contact portion 1110 is not touching the table 302).

The wands 1100 may of course be specifically configured for a certain player and synced with their fund account so that a particular wand 1100 only reclaims the appropriate player's chips (and not chips placed by other players). That is, a first player would be unable to use their wand 1100 to, for example, erase a second player's wagers by contacting the second player's wagered chips and pressing the chip loading button 1106.

Similarly, each player portion 900 may continuously, and in real time, present the value of the appropriate player's chips. For example, each time a player tips the operator, receives chips as the result of a winning wager, places a wager with their wand 1100, erases a wager with their wand 1100, or the like, the player portion 900 may present an updated value. This value may be presented in the form of animated chips, numerical values, or the like.

The wand display 1108 may present the amount of the chips the player has loaded onto the wand 1100 at a given time. The presented information may include the total amount of chips the player has, the number of chips the player is currently wagering, or the like. The wand display 1108 may present this value numerically (in terms of number of chips and/or the dollar amount) or graphically, such as via a bar chart display. The amount presented by the wand display 1108 may be updated in real time. For example, if a player tips an operator by any of the methods discussed above, the wand display 1108 may immediately present an updated value of the player's current chip amount.

The contact portion 1110 of the wand 1100 may be configured in a variety of ways as long as it enables a player to dispense and reclaim chips as desired. To establish a connection with the gaming table, the contact portion 1110 may be implemented as a capacitive stylus (if the gaming table 302 is implemented as a capacitive or resistive display) or a resistive stylus (if the gaming table 302 is implemented as a resistive display).

The wands 1100 may also be configured with certain security mechanisms so that players may not use their wands to take or move other players' chips. In accordance with some embodiments, the wands may include fingerprint sensor devices to gather information regarding the holder's fingerprints. If an "unauthorized" person is holding the wand 1100, the wand 1100 may disable itself to prevent unauthorized wagers. Once an "authorized" holder is holding the wand 1100, the wand 1100 may activate and enable the holder to place wagers or perform other actions.

The wands may also disable once the player is out of chips or may otherwise remain deactivated until funds are credited to the player's fund account. Once the player is out of chips, the display 1108 may present a message instructing the player to deposit funds to their account. Or, if the player borrowed the wand from the gaming establishment, the wand display 1108 may present a message instructing the player to return the wand 1100 to the gaming establishment.

The wands 1100 may additionally be activated and disabled in a number of ways. For example, the wands 1100 may further include movement or location sensors to monitor the location of the wand 1100 and its proximity to a gaming table 302. A wand 1100 may then be disabled (i.e., unable to place any wagers) once it is at a certain distance from the gaming table 302. The wand 1100 may similarly activate (at which point it is able to make wagers) once it is within a predetermined distance from the gaming table 302.

As another security mechanism, the wands 1100 may require a personal identification number (PIN) or other type of access code in order to place wagers or perform certain actions with their wand 1100. Again, this ensures that only a certain person or group of people can operate the wand 1100.

As mentioned above, players may borrow these wands from the gaming establishment or players may purchase their own wands and bring them to the gaming establishment for gaming. These personal wands may come in different configurations and colors and players may customize their wands as they desire. For example, players may have their name engraved in the wand 1100 and decorate their wand as they please. In some embodiments, the wand may include a telescoping extension portion so that gamers can change the length of the wand. This may help a player reach a certain portion of the gaming table 302 more easily.

Figure 12:
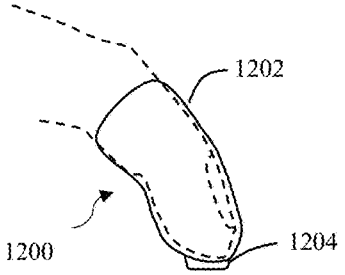
FIG. 12 illustrates a finger attachment device in accordance with one embodiment.

In other embodiments, players may use hand devices such as finger attachments to move their virtual chips as desired. FIG. 12 illustrates a finger attachment device 1200 in accordance with one embodiment. The finger attachment device 1100 may include a finger portion 1202 configured to fit onto a player's finger and a contact portion 1204. The finger portion 1202 may be made of any material as long as it can fit onto a player's finger. The contact portion 1204 may be similar in configuration to the contact portion 1110 of the wand 1100. Players may use these finger attachments 1200 to move, via the contact portion 1204, their chips as they desire. Similar to the wands, this prevents or at least minimizes the spread of germs as players are not required to touch the gaming table 302 with their hands or fingers.

Embodiments of the present invention may be directed towards paddlewheel-type games, such as a computer implementation of Applicant's TRI-WHEEL® game. The TRI-WHEEL® is an example of a class of games including one or more concentric simulated rings—each ring having a plurality of numbers about the perimeter thereof. An example of the TRI-WHEEL® is illustrated on the display 104 of FIG. 1.

In some embodiments, the simulated rings may spin in coordination with each other. That is, the two or more rings spinning are "locked" with each other and do not move independently of each other. Accordingly, a number on one ring always associated with the same numbers on the adjacent rings.

In other embodiments, however, the rings may be simulated to spin independently of each other, such that a number on one ring may come up with different numbers on the other rings on each spin. Instead of one random process for the entire multi-ring graphic wheel, each ring is a separate, randomly selected outcome but appear in the same coordinated wheel spin. This increases the possible combinations of winning spins, and gives gamers more opportunities to make wagers.

Figure 13:
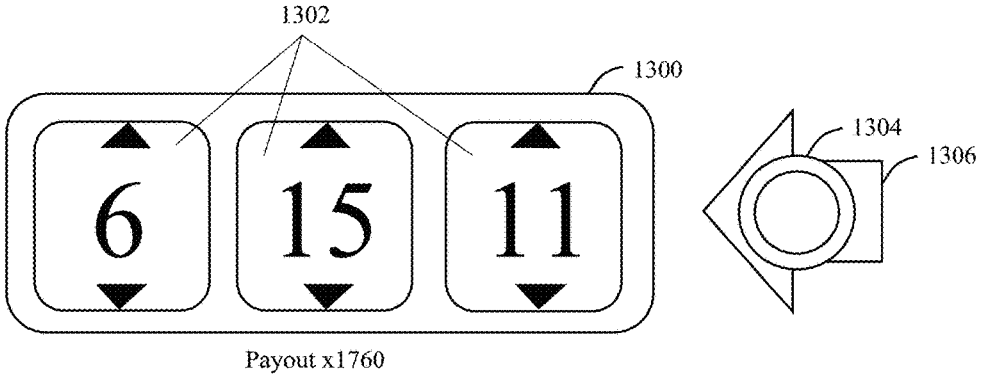
FIG. 13 illustrates a scroll bar in accordance with one embodiment.

In addition to using the wagering field to place wagers as described previously, players may also use a scroll bar such as the scroll bar 1300 of FIG. 13. The scroll bar 1300 may include three scrolling portions (e.g., one for each ring). There may be as many scroll bars as player positions at the table.

To place a wager on a particular ring, a player may vertically scroll or otherwise dial the appropriate portion 1302 to highlight a number or symbol they wish to select. They may scroll to a "0" or blank icon if they do not wish to place a wager for a particular ring. Alternatively, there may be an auto-pick feature that randomly picks a number for each ring. Once the player is satisfied with their choices for each ring, they may move one or more of their virtual chips 1304 onto an arrow or other symbol 1306. This may prevent any further changes to the selected numbers. Although three portions 1302 are illustrated, the scroll bar 1300 may include any number of portions, and may depend on the number of rings.

In these embodiments, payouts can be any amount depending on the jurisdiction, the operator, the particular table, or the like. The payouts can be progressive, in which case the scroll bar 1300 may present a player's payout amount that may continue to increase. As illustrated in FIG. 1, these features may be implemented on the table displays, mobile devices, tablets, etc.

Managing and running games electronically in accordance with the various embodiments described herein may achieve numerous advantages. For example, operators do not need to count out the number of chips bet. Rather, the chips are virtual and can be purchased from gaming establishments and wagered electronically.

Another benefit is that all chip traffic is electronically stored and recorded in the event server 102. This ensures greater accuracy and quicker auditing than with existing chip/ticket systems used in conventional casinos or other gaming institutions.

Additionally, electronically simulated wheels (and the electronically-generated random outcomes) solve the aforementioned "wheel pitching" problem by eliminating manual spins. The use of the virtual chips, whose positions are unchangeable once a spin has been called, also prevents late wagering. Another advantage is that electronic gaming eliminates the overhead costs associated with printing paper tickets.

The systems and methods described herein also provide for a number of regulatory benefits. From a regulatory perspective, the efficacy of randomness requires inspection of one device over dozens or even hundreds of devices that may otherwise be operated. The ability of regulatory officials to unobtrusively monitor a game or a location in at least substantially real time is enhanced by their ability to monitor all sales, bets, and payoffs that are stored on the event server 102. This is opposed to existing methods, in which a regulatory official may need to visit each location to inspect the balance of wheels, records of cash receipts, payout summaries, and cash reports.

For organizations that operate these games, especially those with multiple gaming locations, having all records accessible from one statewide central server allows the organizations to know exactly what the cash bank should be at any given location at any given time. These organizations can therefore monitor their locations unobtrusively and without on-site operators knowing that they are being monitored.

It is also noted that live, active gaming may not occur at all times. Nonetheless, the gaming tables 302 may still provide some forms of entertainment. They may allow for "mock" games between players (i.e., games without wagering with real money). Players may also practice certain games or play other, non-wagering games such as those based on conventional games (e.g., board games, trivia games, or the like).

Applications unrelated to gaming may also incorporate features of the gaming table 302 and system 100. In particular, applications in which users need to add/subtract units of value may benefit from the features of the invention.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Embodiments of the present disclosure, for example, are described above with reference to block diagrams and/or operational illustrations of methods, systems, and computer program products according to embodiments of the present disclosure. The functions/acts noted in the blocks may occur out of the order as shown in any flowchart. For example, two blocks shown in succession may in fact be executed substantially concurrent or the blocks may sometimes be executed in the reverse order, depending upon the functionality/acts involved. Additionally, or alternatively, not all of the blocks shown in any flowchart need to be performed and/or executed. For example, if a given flowchart has five blocks containing functions/acts, it may be the case that only three of the five blocks are performed and/or executed. In this example, any of the three of the five blocks may be performed and/or executed.

A statement that a value exceeds (or is more than) a first threshold value is equivalent to a statement that the value meets or exceeds a second threshold value that is slightly greater than the first threshold value, e.g., the second threshold value being one value higher than the first threshold value in the resolution of a relevant system. A statement that a value is less than (or is within) a first threshold value is equivalent to a statement that the value is less than or equal to a second threshold value that is slightly lower than the first threshold value, e.g., the second threshold value being one value lower than the first threshold value in the resolution of the relevant system.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of various implementations or techniques of the present disclosure. Also, a number of steps may be undertaken before, during, or after the above elements are considered.

Having been provided with the description and illustration of the present application, one skilled in the art may envision variations, modifications, and alternate embodiments falling within the general inventive concept discussed in this application that do not depart from the scope of the following claims.

What is claimed is:

1. An interactive gaming system, the system comprising:

an interactive electronic gaming display configured to present a plurality of virtual chips to each of a plurality of gamers to enable each of the plurality of gamers to interact with the interactive electronic gaming display, and further configured to receive a wager from a wand device in removable contact with the interactive electronic gaming display and the wand device used by at least one of the plurality of gamers so that the gamers do not have to physically touch the display and thereby prevent the spread of germs, wherein the the wand device includes:

a contact portion configured to detect contact between the wand device and the interactive electronic gaming display to pair at least one virtual chip from the interactive electronic gaming display;

a chip loader button configured to, upon activation and upon the contact portion detecting contact between the wand device and the interactive electronic gaming display, select at least one virtual chip from the interactive electronic gaming display to associate the selected chip with the gaming wand;

a wand display configured to present an amount of virtual chips a gamer has paired with the wand device from the interactive electronic gaming display;

a chip emitter button configured to, upon activation and detecting by the contact between the wand device and a portion of the interactive electronic gaming display that represents a wager, transfer a predetermined number of virtual chips from the wand display to a portion of the interactive electronic gaming display that represents the wager on the interactive electronic gaming display and in contact with the contact portion of the wand device.

2. The system of claim 1, wherein the wand device is a hand device configured to be attached to a gamer's hand.

3. The system of claim 1, wherein the plurality of virtual chips includes at least one chip eraser accessible by at least one of the plurality of gamers to cancel a previously made wager.

4. The system of claim 1, wherein the received at least one wager relates to a paddlewheel-type game.

5. The system of claim 4, wherein the received at least one wager relates to an outcome generated by a plurality of independent simulated rotating rings of a wheel.

6. The gaming system of claim 1, further comprising a plurality of wand devices that are each in removable contact with the interactive electronic gaming display, wherein each of the plurality of wand devices are used by a different gamer and each gamer's wand is incapable of recognizing another gamer's virtual chips on the interactive electronic gaming display.

7. The gaming system of claim 1, wherein the the wand device is further configured to move or remove at least one virtual chip from a portion of the interactive electronic gaming display.

8. An interactive gaming system, the system comprising:

an interactive electronic gaming display configured to present a plurality of virtual chips to each of a plurality of gamers to enable each of the plurality of gamers to interact with the interactive electronic gaming display, wherein the interactive electronic gaming display is further configured to:

receive a wager from a wand device in removable contact with the interactive electronic gaming display and used by the at least one of the plurality of gamers, wherein the wand device includes:

a contact portion configured to detect contact between the wand device and the interactive electronic gaming display to pair at least one virtual chip from the interactive electronic gaming display, a chip loader button configured to, upon activation and upon the contact portion detecting contact between the wand device and the interactive electronic gaming display, select at least one virtual chip from the interactive electronic gaming display to associate the selected chip with the gaming wand;

a wand display configured to present an amount of virtual chips a gamer has paired with the wand device from the interactive electronic gaming display;

a chip emitter button configured to, upon activation and detecting, by the contact portion contact between the wand device and a portion of the interactive electronic gaming display that represents a wager, transfer a predetermined number of virtual chips from the wand display to the portion of the interactive electronic gaming display that represents the wager on the interactive electronic gaming display and in contact with the contact portion of the wand device; and enable chip transactions between at least two fund accounts in response to movement of at least one chip from a first portion of the interactive electronic gaming display that corresponds to a first fund account to a second portion of the interactive electronic gaming display that corresponds to a second fund account, wherein the first fund account is an account configured for a gamer and the second fund account is an account configured for a table operator so that a gamer may tip the table operator by moving the at least one chip from the first portion to the second portion of the interactive electronic gaming display device by:

touching the display with the wand device at the first portion of the display that corresponds to at least one virtual chip, and making a flicking gesture of the interactive electronic display device to propel that at least one virtual chip in a trajectory that ends at or near the second portion of the interactive electronic display device, wherein the second portion is a tip-receiving area for the table operator.

9. The system of claim 8, wherein a gamer may move the at least one chip from the first portion to the second portion by:

touching the display with their finger at the first portion of the display that corresponds to at least one chip;

making a dragging gesture on the display to move the at least one chip from the first portion to the second portion; and removing their finger from the display at the second portion.

10. The system of claim 8, wherein the at least one virtual chip may appear to travel below other graphics that are presented by the interactive electronic gaming display while moving towards the second portion of the interactive electronic gaming display.

11. The system of claim 8, wherein the movement of the at least one virtual chip from the first portion to the second portion may include the at least one virtual chip banking off a border of the display of the interactive electronic gaming display.

* * * * *